United States Patent [19]

Markowski et al.

[11] Patent Number: 4,902,864

[45] Date of Patent: Feb. 20, 1990

[54] VERSATILE ELECTRIC DISCONNECT SWITCH

[75] Inventors: Robert G. Markowski, East Haven; Dean A. Robarge, New Britain; Robert L. Owens, Southington, all of Conn.; Jerome B. Tankersley, III, Fredericksburg, Va.

[73] Assignee: General Electric Company, New York, N.Y.

[21] Appl. No.: 281,614

[22] Filed: Dec. 9, 1988

[51] Int. Cl.[4] ..... H01H 5/08

[52] U.S. Cl. ..... 200/459; 200/329; 335/189

[58] Field of Search ..... 200/401, 443, 280, 329, 200/330, 335, 337, 338, 453, 458, 459, 400; 335/185, 186, 189, 190, 191; 74/97, 491, 523; 403/4

[56] References Cited

U.S. PATENT DOCUMENTS 659,946 10/1900 Whittingham ..... 200/459

3,272,953 9/1966 Tillson ..... 200/330

4,778,959 10/1988 Sabatella et al. ..... 200/144

4,804,807 2/1989 Knapp et al. ..... 200/331

FOREIGN PATENT DOCUMENTS 281152 12/1927 United Kingdom ..... 200/458

321420 11/1929 United Kingdom ..... 200/459

*Primary Examiner*—Henry J. Recla

*Assistant Examiner*—Glenn T. Barrett

*Attorney, Agent, or Firm*—Richard A. Menelly; Walter C. Bernkopf; Fred Jacob

[57] ABSTRACT

A fast operating disconnect switch minimizes the arc that occurs when the switch contacts are opened or closed by operation of a rotor assembly while the switch is electrically energized. A powerful operating spring within the operating mechanism under the control of a handle operator assembly overcenters upon the ON-OFF as well as OFF-ON movement of the handle operator. The handle operator assembly is adapted for either left-hand or right-hand mounting to a common rotor assembly.

10 Claims, 4 Drawing Sheets

VERSATILE ELECTRIC DISCONNECT SWITCH

BACKGROUND OF THE INVENTION

U.S. Pat. No. 4,778,959 describes an operating handle mechanism arranged for rapid connection and disconnection of the switch contacts by means of a powerful operating spring. The operating spring overcenters during the ON-OFF and OFF-ON movement of the handle operator and the contact separation is deferred by means of a retainer spring until the operating spring is overcentered. The rapid make and break connection between the switch contacts substantially reduces the magnitude of the arc that occurs when the contacts are separated while the switch is energized.

When several such switches are mounted within a panelboard assembly, the switches are arranged for either "left-hand" or "right-hand" operation within the panelboard enclosure. Since the manually-driven operating mechanism links with the rotor assembly to drive the contacts between their closed and opened positions, a left-handed operating mechanism is generally arranged with a left-handed rotor-driven contact assembly. A right-handed operating mechanism accordingly is associated with a right-handed rotor-driven contact assembly.

To substantially reduce the inventory requirements of left-handed operating mechanisms and rotor assemblies along with right-handed operating mechanisms and rotor assemblies this invention proposes to provide a versatile disconnect switch containing a common operating mechanism and rotor assembly arranged for either left-handed operation, right-handed operation or both.

DESCRIPTION OF THE PREFERRED EMBODIMENT

Figure 1:
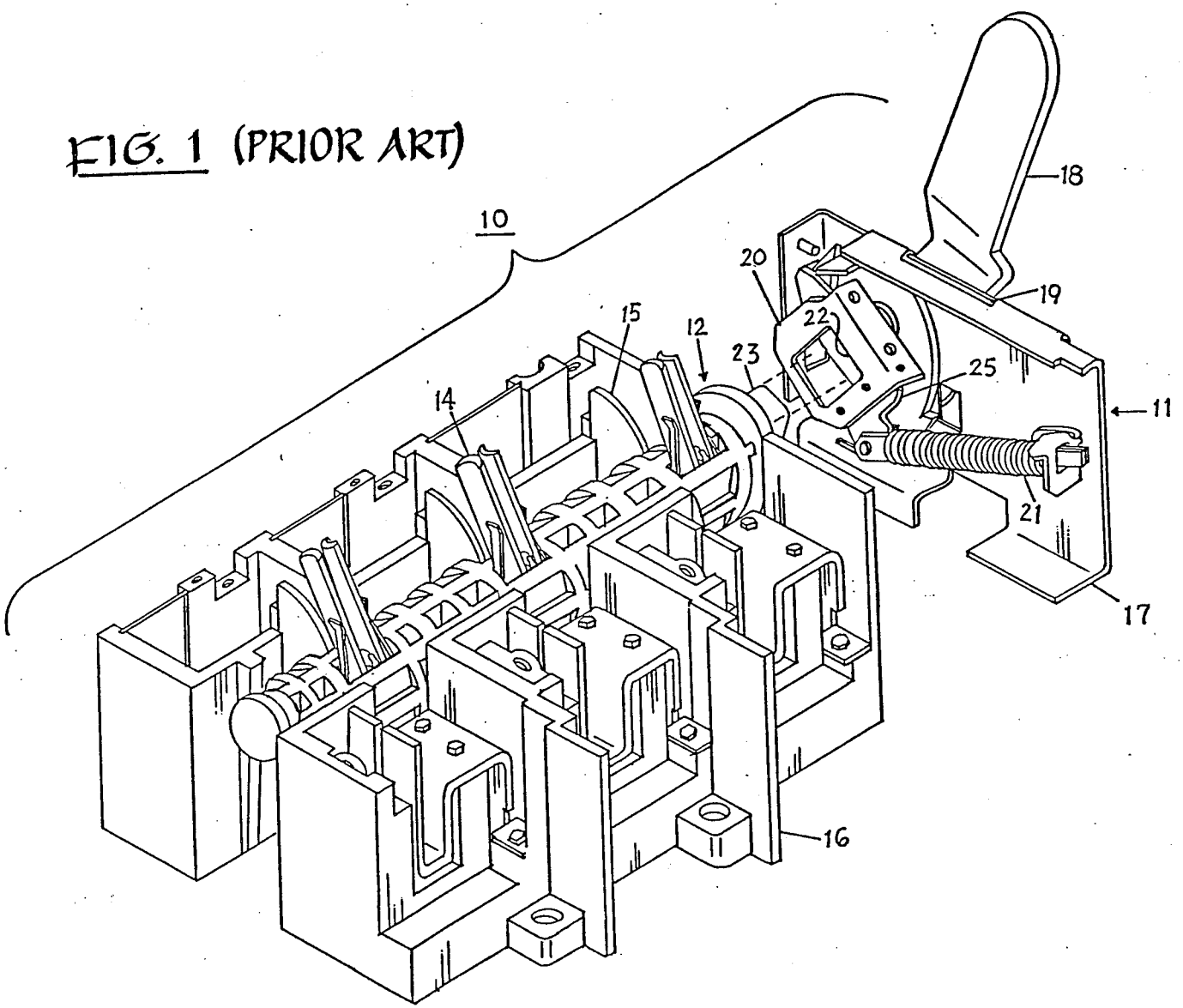
FIG. 1 (PRIOR ART)
FIG. 1 is a top perspective view of a right-hand operated electric disconnect switch in accordance with the prior art.

Before discussing the versatile disconnect switch according to the invention, it is helpful to review briefly an electric disconnect switch 10 as depicted in FIG. 1 which represents the advanced state of the art. The switch is described in aforementioned U.S. Pat. No. 4,778,959 which patent is incorporated herein for purposes of reference and should be reviewed for its description of the interaction between the switch operating components. The switch 10 requires an operating mechanism assembly 11 which engages a rotor assembly 12 for driving a plurality of contact blades 14 in-and-out of connection with corresponding contact stabs 15. A corresponding plurality of insulative barriers 16 are arranged between the individual contact blades and stabs for electrically isolating such blades and stabs when connected to the individual phases of a multiphase electrical distribution system. The operating mechanism assembly includes a handle support frame 17 to which an operating handle 18 is attached and which extends through an elongated handle slot 19. The handle connects with a rotor drive member 20 for rotating the rotor assembly in cooperation with a powerful operating mechanism spring 21. The operating mechanism assembly connects with the rotor assembly by trapping the rectangular post 23 extending from the end of the rotor assembly within a rectangular slot 22 formed within the rotor drive operator 20. As described within the aforementioned U.S. Pat. No. 4,778,959 the detent spring 25 retains the rotor assembly 12 from movement until the operating mechanism spring 21 has reached its overcenter position. The operating mechanism 11 is arranged for a right-handed operator with respect to the right-handed rotor assembly 12. When a left-handed operating mechanism is required, the operating mechanism component parts and the rotor assembly are correspondingly reversed during the assembly process.

Figure 2A:
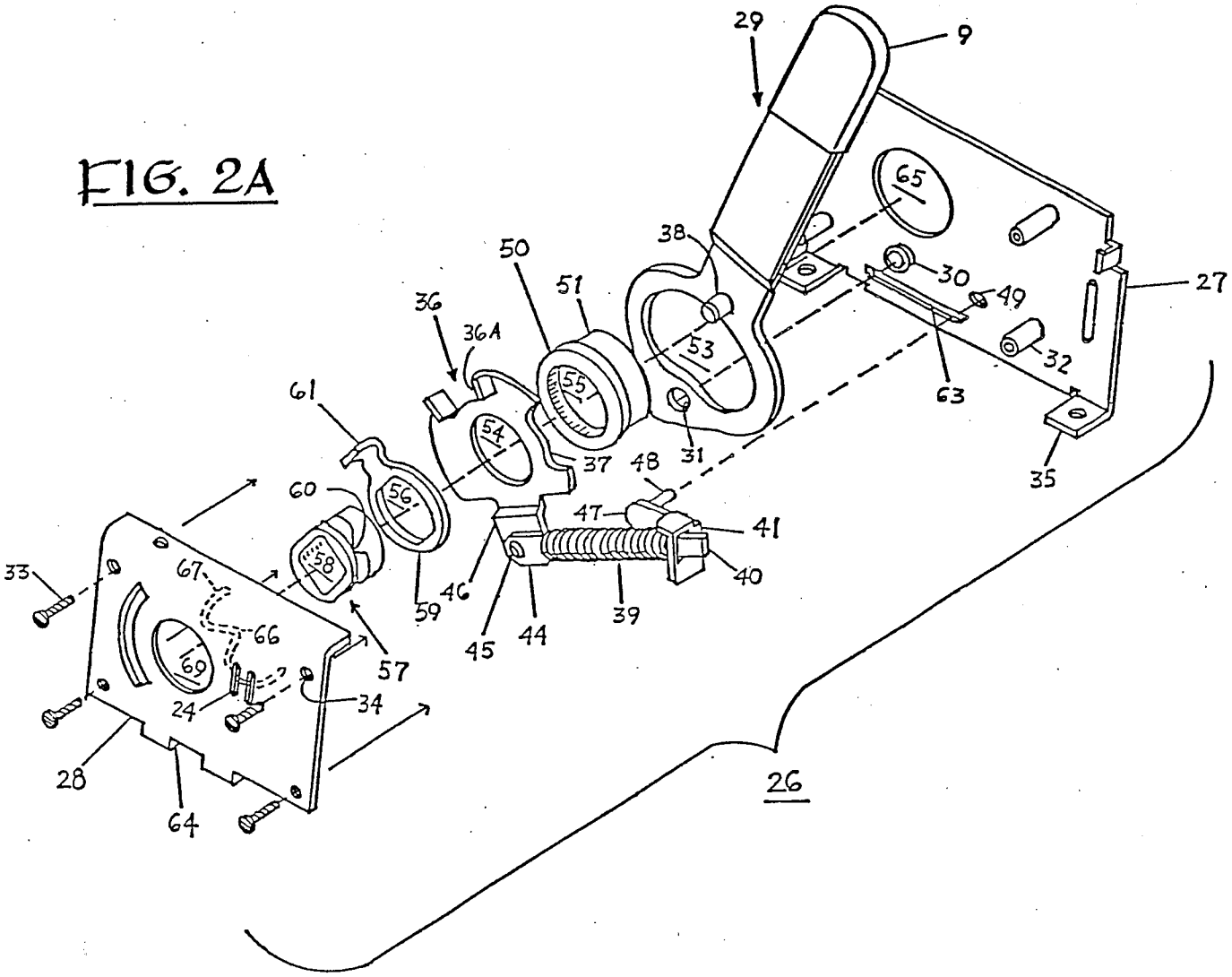
FIG. 2A is a top perspective view in isometric projection of a combined left-handed - right-handed operating mechanism in accordance with the invention.

The operating mechanism assembly of the versatile disconnect switch according to the invention is depicted at 26 in FIG. 2A prior to assembly. The assembly includes a pair of opposing side frames 27, 28 which are fastened together by means of machine screws 33 and threaded spacers 32 attached to the inner surface of side frame 27 and thru-holes 34 formed through side frame 28. The operating handle 29 is pivotally attached to side frame 27 by arranging the opening 31 on the bottom of tee operating handle around the handle pivot 30 fixedly attached to the interior surface of side frame 27. The operating handle includes an insulative sleeve 9 to electrically isolate the operator from the metallic switch components. An oval opening 53 is defined within the operating handle which is arranged concentrically with the opening 65 formed through the side frame 27. A drive pin 38 extending from the operating handle is trapped between the confines of an actuator slot 37 formed on the exterior surface of the actuator 36. The operating mechanism spring 39 is arranged on a spring guide 40 which in turn is pivotally attached to a tab 46 extending from the actuator by means of a yoke 44 formed on the end of the spring guide to which the actuator tab is attached by means of the pivot pin 45. The operating spring 39 is supported on the side frame 27 by means of a support member 41 through which the end of the spring guide extends. A tab 47 on the end of the spring guide includes a pin 48 extending from the tab which pin is received within a thru-hole 49 formed within the side frame 27. A nylon flange 50 defining a circular opening 55 and having a circular skirt 51 extending from one side, interfaces between the operating handle 29 and the actuator 36 with the skirt 51 extending through both the oval opening 53 formed in the operating handle and the opening 65 formed within the side frame 27. The nylon flange positions and supports a plastic or elastomeric sleeve 57 which passes through the drive ring central opening 56, actuator central opening 54, and the operating handle oval opening 53. The rectangular opening 58 within the plastic sleeve 57 is accessible through the opening 65 within side frame 27 as well through the opening 69 within the side frame 28. The plastic sleeve comprises a thermoplastic material such as VALOX which is a trademark of GE Company for thermoplastic resin. A perimetric groove 60 on the exterior surface of the plastic sleeve receives the end 67 of the delay spring 66 which is positioned on the interior surface of side frame 28 by means of a pair of delay spring support slots 24 formed therein. The drive ring 59 interacts with the actuator 36 by trapping the tab 61 on the drive ring within the slot 36A formed within the outer perimeter of the actuator. When the side frames 27, 28 are fastened together by means of the machine screws 33, thru-holes 34 and threaded spaces 32, the bent retainer tabs 64 on the bottom of the side plate 28 are received within the elongated slot 63 on the bottom of the side plate 27 such that when the assembled operating mechanism assembly 26 is supported within the switch housing (not shown) by means of the support tabs 35, the rectangular opening 58 in the plastic sleeve is thereby accessible from both sides of the assembly by means of the circular openings 65, 69.

Figure 2B:
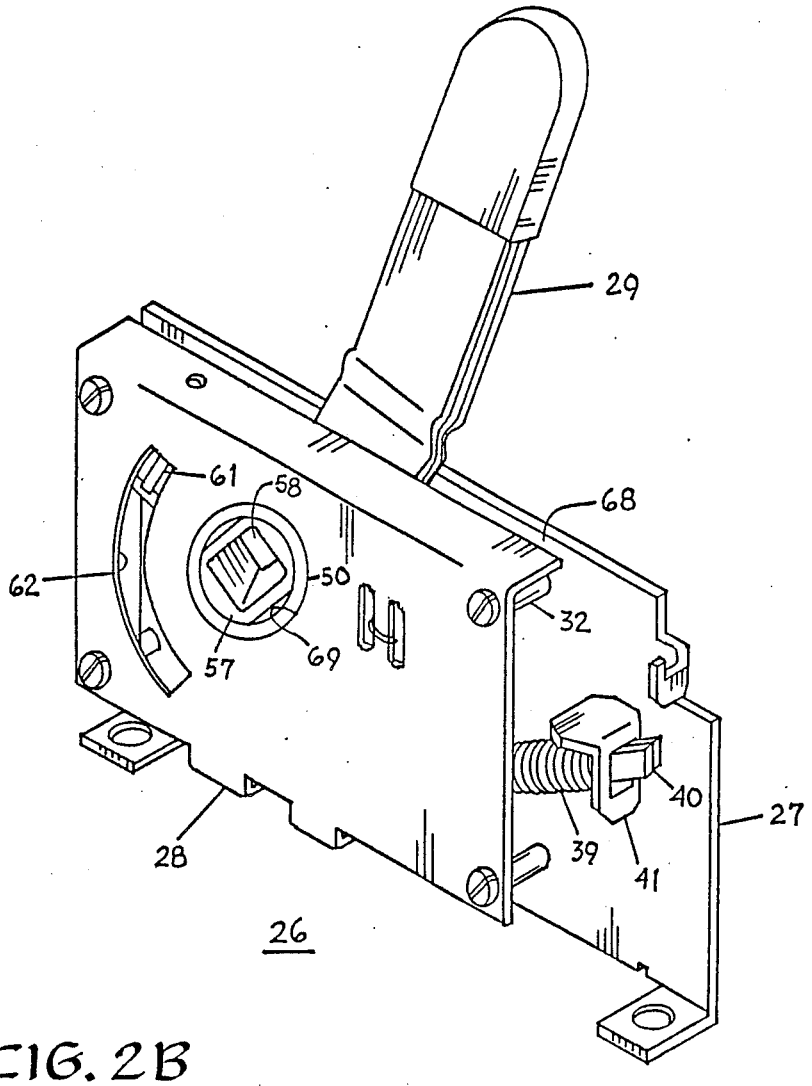
FIG. 2B is a front perspective view of the disconnect switch from FIG. 2A after assembly.

The completed assembly 26 is depicted in FIG. 2B with the operating handle 29 extending upward within the clearance slot 68 defined between the side frames 27, 28 by means of the threaded spacers 32. The plastic sleeve 57 with the rectangular opening 58 is shown accessible through the opening 69 within side frame 28. The rectangular opening 58 is also accessible through the opening 65 in the side frame 27, described earlier with respect to FIG. 2A. With the operating mechanism assembly completely assembled, it is noted that the tab 61 on the drive ring is free to rotate within the arcuate guide slot 62 as the operating handle 29 is rotated in the clockwise and counterclockwise direction, which thereby allows the operating mechanism assembly to be installed on either the right hand or left hand side of a corresponding rotor assembly 12' as best seen by referring now to FIG. 3.

Figure 3:
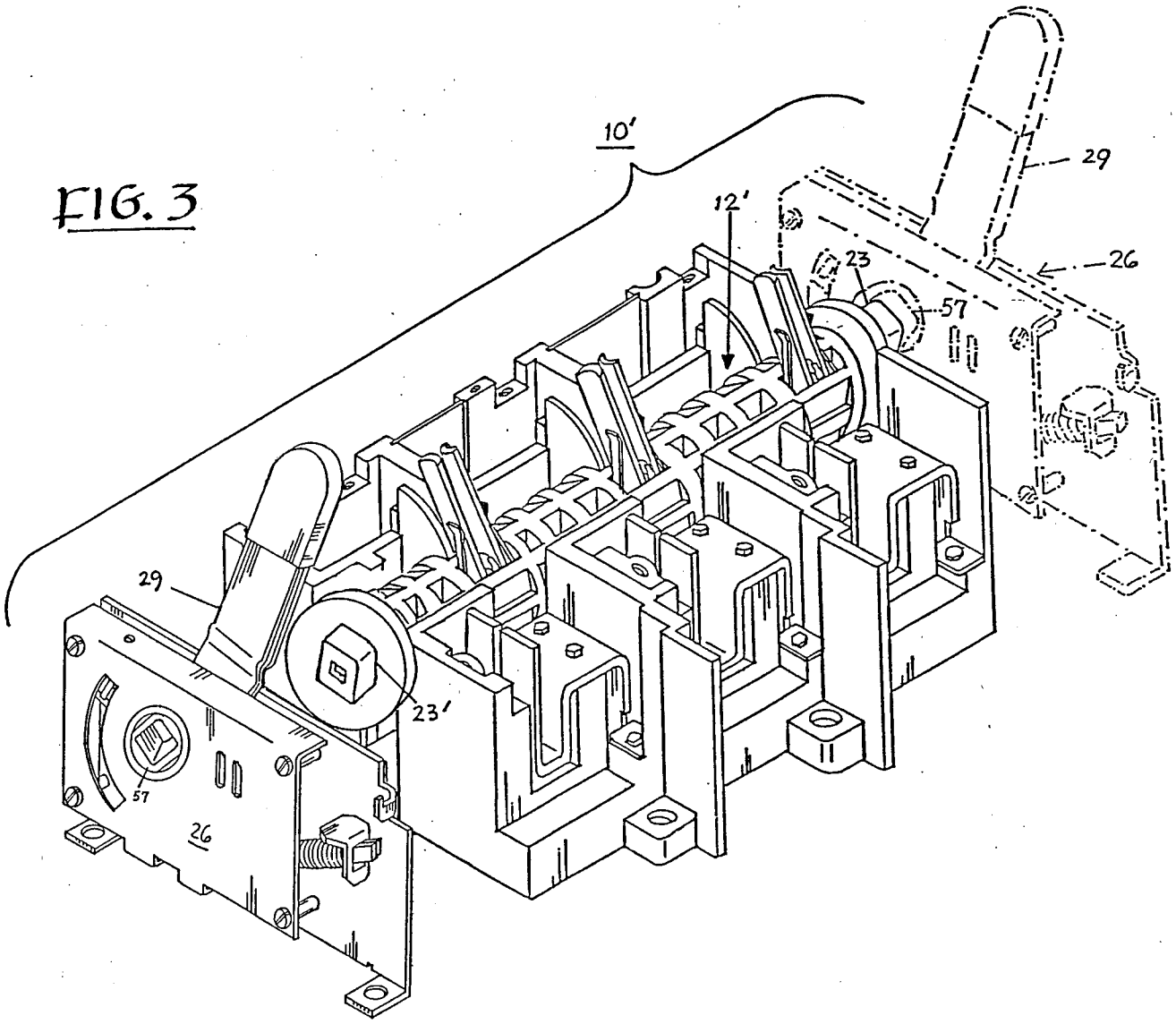
FIG. 3 is a top perspective view of a disconnect switch in accordance with the invention.

The disconnect switch 10' shown in FIG. 3 depicts one operating mechanism assembly 26 to the left of the switch with a similar operating mechanism assembly indicated in phantom to the right of the switch. Both of the operating assemblies can be accommodated by means of the common rotor assembly 12'. The rotor assembly differs from that depicted earlier in FIG. 1 by the inclusion of a rectangular post 23 at one end thereof with a corresponding rectangular post 23' formed on the opposite end. The rectangular posts 23, 23' can accommodate the plastic sleeve 57 such that the operating handle 29 can be operated from either the left or the right-hand side of the switch 10'.

A versatile disconnect switch has herein been described which substantially reduces the number of parts to be inventoried for left-hand and right-hand applications. A multi-functional common rotor assembly has been shown to accept the versatile operating mechanism assembly on either side thereof without the requirement of separate left-hand and right-hand rotors and corresponding left-hand and right-hand operating handle assemblies.

Having thus described our invention, what we claim as new and desire to secure by Letters Patent is:

1. An operating handle assembly for an electric disconnect switch comprising:

a pair of first and second parallel opposing side plates each having an opening therethrough;

an operating handle pivotally supported on one of said side plates defining an opening at one end and including a handle extension on an opposite end;

an actuator lever defining a circular opening and including a perimetric slot formed on an outer surface and a tab extending from said outer surface, said tab being pivotally attached to an operating spring guide having an operating spring arranged thereon, said perimetric slot being captured within a post extending from said operating handle for driving said actuator lever in a clockwise and counterclockwise direction in response to manual operation of said operating handle;

a drive ring defining a non-circular opening concentric with said circular opening formed within said actuator lever and including a tab extending from one end, said drive ring tab being captured within a second perimetric slot formed within said actuator lever outer surface and extending within an arcuate slot formed within the other of said side plates; and a non-circular sleeve extending through said openings in said first and second side plates, said drive ring opening, said actuator lever opening and said operating handle opening, said sleeve including a non-circular opening adapted to receive a non-circular drive shaft whereby said counterclockwise and said clockwise motion is transmitted to said drive shaft.

2. The operating handle assembly of claim 1 including a delay spring attached to one of said side plates and associated with said non-circular sleeve for retaining said non-circular sleeve from rotation until said operating spring reaches its overcenter position overcenters.

3. The operating handle assembly of claim 1 including a flange interfacing between said operating handle and said actuator lever.

4. The operating handle of claim 1 including a plurality of threaded spacers interfacing between said side plates to define a predetermined distance between said side plates.

5. An electric disconnect switch comprising in combination:

an operating mechanism, a rotary assembly having a pair of ends, and an operating handle;

said operating mechanism including an operating spring arranged for driving said rotor assembly that includes at least one contact stab in and out of electric connection with a stationary contact blade upon manual operation of said operating handle;

a non-circular sleeve extending through said operating mechanism for being captured by a corresponding non-circular shaft extending from each of said ends of said rotor assembly;

whereby said operating mechanism is manually operational from both of said ends of said rotor assembly; and includes a pair of opposing parallel apertured side plates wherein said non-circular sleeve extends through both of said side plates and said operating handle is pivotally supported on one of said side plates and said operating handle is pivotally supported on one of said side plates.

6. The electric disconnect switch of claim 5 wherein said non-circular sleeve comprises an elastomeric.

7. The electric disconnect switch of claim 5 wherein said operating mechanism further includes an actuator lever having a perimetric slot formed on an exterior surface and said operating handle includes a pin extending from one side, said pin being captured within said slot to cause said actuator to move in response to manual operation of said operating handle.

8. The electric disconnect switch of claim 7 wherein one of said side frames includes a pin extending from an interior surface and wherein said operating handle includes an aperture, said side frame pin being received within said aperture to pivotally retain said operating handle to said one side frame.

9. The electric disconnect switch of claim 8 further including a flange intermediate said operating handle and said actuator lever.

10. The electric disconnect switch of claim 9 including a drive ring intermediate said actuator lever and the other of said side frames, said drive ring including a tab extending from one side, said drive ring tab being captured within an arcuate slot formed within said other side frame.

* * * * *

UNITED STATES PATENT AND TRADEMARK OFFICE

CERTIFICATE OF CORRECTION

PATENT NO. : 4,902,864

DATED : 2/20/90

INVENTOR(S) : Markowski et al.

It is certified that error appears in the above-identified patent and that said Letters Patent is hereby corrected as shown below:

IN THE CLAIMS

Claim 2, line 5, after "position" delete --overcenters--.

Claim 5, line 21, after "plates" delete --and said operating handle is pivotally supported on one of said side plates--.

Signed and Sealed this

Fourth Day of December, 1990

*Attest:*

*Attesting Officer*

HARRY F. MANBECK, JR.

*Commissioner of Patents and Trademarks*